US006012707A

United States Patent [19]

Enlund

[11] Patent Number: 6,012,707

[45] Date of Patent: Jan. 11, 2000

[54] ARRANGEMENT FOR CONTROLLING TENSION IN A WINCH CABLE CONNECTED TO ROCK DRILLING EQUIPMENT

[75] Inventor: Pentti Enlund, Tampere, Finland

[73] Assignee: Tamrock Oy, Finland

[21] Appl. No.: 08/952,487

[22] PCT Filed: Apr. 30, 1996

[86] PCT No.: PCT/FI96/00238

§ 371 Date: Nov. 19, 1997

§ 102(e) Date: Nov. 19, 1997

[87] PCT Pub. No.: WO96/36554

PCT Pub. Date: Nov. 21, 1996

[30] Foreign Application Priority Data

May 19, 1995 [FI] Finland ..... 952467

[51] Int. Cl.[7] ..... B66D 1/08

[52] U.S. Cl. ..... 254/361; 254/323; 254/377

[58] Field of Search ..... 254/361, 323, 254/377

[56] References Cited

U.S. PATENT DOCUMENTS

| | | | |
|---|---|---|---|
| 3,180,090 | 4/1965 | Hawley et al. | 254/361 |
| 3,253,683 | 5/1966 | Stein | 254/361 |
| 3,380,545 | 4/1968 | Kemper | 254/361 |
| 3,780,990 | 12/1973 | Edlund et al. | 254/361 |
| 3,817,033 | 6/1974 | Appel et al. | 254/361 |
| 3,871,714 | 3/1975 | Behred | 254/361 |
| 4,043,125 | 8/1977 | Kubik | 60/406 |
| 5,007,599 | 4/1991 | Forsyth | 254/377 |
| 5,735,506 | 4/1998 | Warnan | 254/361 |

FOREIGN PATENT DOCUMENTS

239452 T3 7/1990 Sweden .

OTHER PUBLICATIONS

Derwnt's abstract, No. 93–310466/39, week 9339, Abstract of SU, 1763350 (As Belo Machine Reliability), Sep. 23, 1992.

*Primary Examiner*—Donald P. Walsh
*Attorney, Agent, or Firm*—Nixon & Vanderhye P.C.

[57] ABSTRACT

An arrangement for controlling a winch cable connected to rock drilling equipment, the arrangement including the winch; a pressure fluid motor arranged to operate the winch; a pressure fluid pump for operating the pressure fluid motor; a pressure-controlled pressure relief valve installed between a pair of pressure fluid channels connected to the pressure fluid motor for setting a counterpressure of the pressure fluid motor when pulling the cable off a drum; and control means for controlling counterpressure of the pump; wherein the pump is a pressure-controlled volume flow pump and the control means comprise an adjusting device with which a control pressure prevailing in a control channel of the pressure relief valve can be adjusted for setting a limit pressure of the pressure relief valve and thus the counter-pressure of the pressure fluid motor.

3 Claims, 2 Drawing Sheets

ARRANGEMENT FOR CONTROLLING TENSION IN A WINCH CABLE CONNECTED TO ROCK DRILLING EQUIPMENT

BACKGROUND AND SUMMARY OF THE INVENTION

The invention relates to an arrangement for controlling a winch of a rock drilling equipment, the arrangement comprising a winch operated by a pressure fluid motor, a pump for operating the pressure fluid motor, a pressure-controlled pressure relief valve installed between pressure fluid channels of the pressure fluid motor for setting the counterpressure of the pressure fluid motor when pulling a wire off a wire drum, and control means for controlling the counterpressure of the pump.

In rock drilling equipments, typically in drill carriages, a winch is used when drilling on gradient planes, whereby the wire or cable of the winch is connected from its one end to the ground, usually to rock in such a manner that the equipment can be lowered on it down a slope and correspondingly, hauled back up after drilling is finished. In order that the equipment would stay put and there can be no sliding and sudden tightening of the wire and possible breaking as a result of it, the wire is always kept tight during driving in such a manner that the pressure of the pressure fluid affects the winching motor of the wire or that there is a pressure relief valve forming counterpressure between the pressure channels of the winching motor when releasing the wire. This kind of solution is disclosed in Finnish Published Specification 840,505. In the reference cited pressure fluid is supplied to the motor of the winch by means of a gear pump, the volume flow of the fluid produced by the pump being constant. Furthermore, the solution comprises a pressure relief valve connected between the pressure channels of the winching motor which valve is controlled by the pressure of the drive motor so that when driving down a slope the limiting pressure of the pressure limiter is lower than when reversing up the slope and spooling the wire at the same time. A problem of this solution is that the pump of the winch constantly produces pressure fluid that revolves in the pressure channel system of the winch. When spooling the wire off, both the pressure fluid flow produced by the motor and the pressure fluid flow from the pump have to be conducted through a pressure relief valve, whereby it is very difficult or practically impossible to adjust the tightness of the wire low enough. Moreover, the constant pressure fluid flow from the pump through the pressure relief valve to the container creates both energy loss and warmth, which needlessly strains the equipment. Further, when reversing the equipment, the operating speed of the winch cannot be adjusted as required, but when driving fast, the wire tends to slacken and go under the crawlers. Nor is it possible to adjust the tightness of the wire when reversing and spooling the wire.

The object of this invention is to provide an arrangement with which the adjustment of the tightness or tension of the wire and the spool speed or the spooling speed in both driving forwards and reversing is easily accomplished and easily adjusted.

The arrangement according to the invention is characterized in that the pump is a pressure-controlled volume flow pump and that the control means comprise an adjusting device with which the control pressure prevailing in the control channel of the pressure relief valve can be adjusted for setting the limit pressure and thus the counterpressure of the pressure fluid motor.

The essential idea of the invention is that a pressure-controlled volume flow pump is used for the pressure fluid pump of the winch and that it comprises an adjustment device which can be connected to control either the control pressure value of the pressure relief valve or the volume flow of the pressure fluid pump as required by the driving situation. An advantage of the arrangement according to the invention is that the tightness of the wire can be adjusted lower or higher in the desired manner when driving the equipment forwards, whereby the loading of the wire can be maintained suitable as required by the conditions. A further advantage is that when reversing, the volume flow of the pressure fluid pump and thus the speed of rotation of the winch can be adjusted, whereby the is force effective on the wire can be adjusted at the same time.

The invention will be explained in more detail in the accompanying drawings.

DETAILED DESCRIPTION OF THE DRAWINGS

Figure 1:
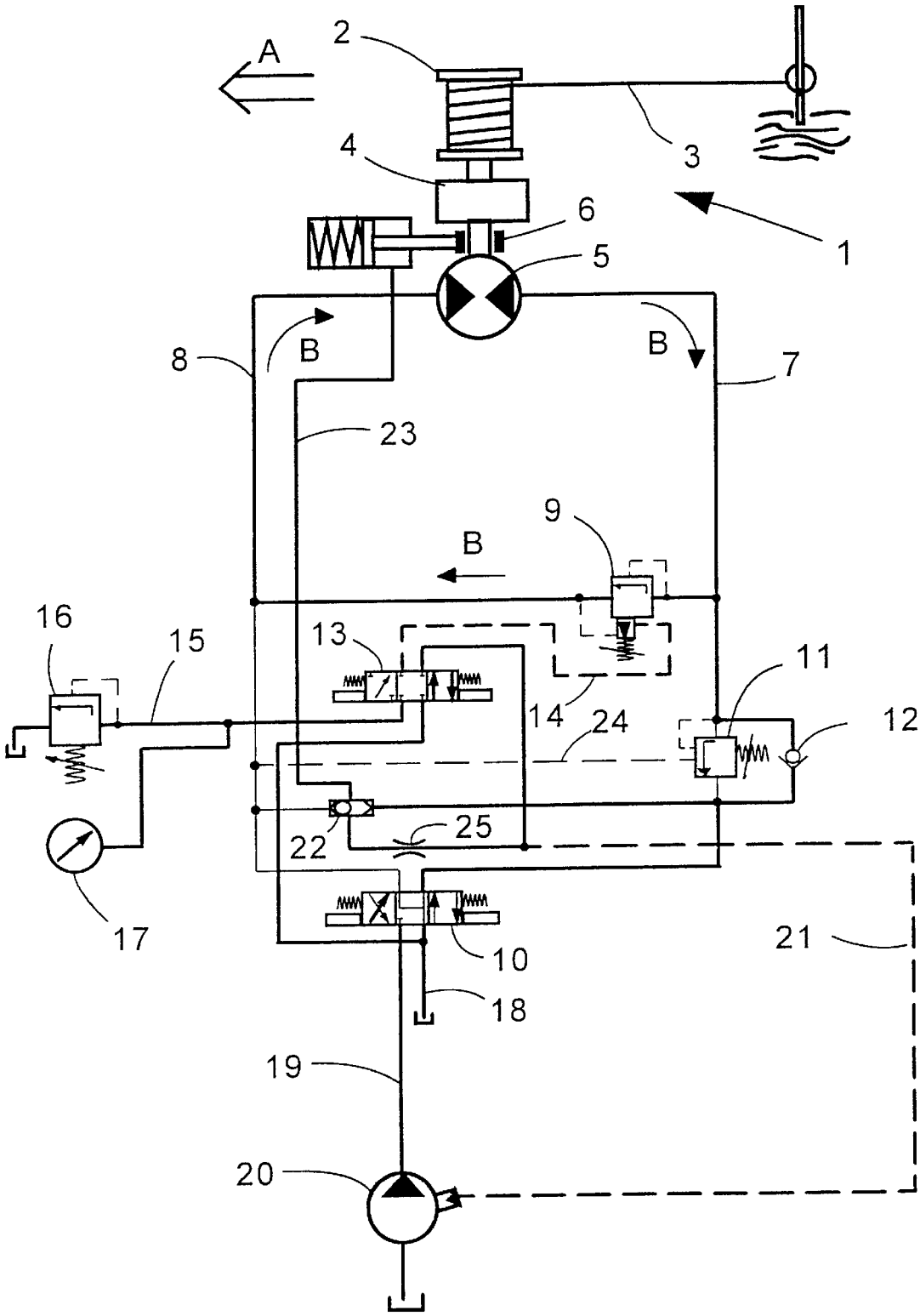
FIG. 1 shows a schematic view of the arrangement according to the invention when driving a rock drilling equipment forwards at the same time as a wire is spooled off the drum.
Figure 2:
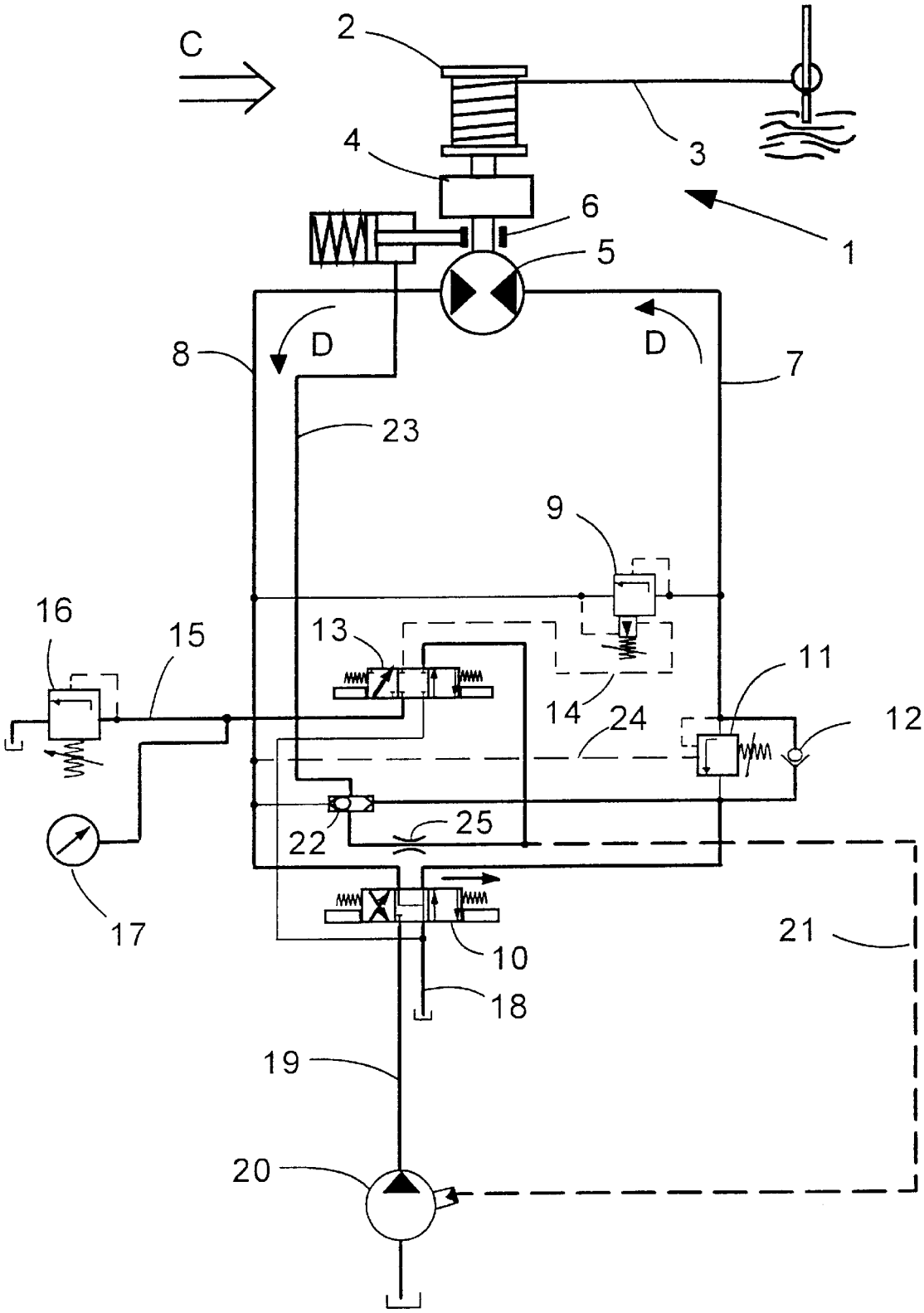
FIG. 2 shows a schematic view of the invention according to FIG. 1 when driving in the opposite direction and when spooling the wire onto the wire drum.

FIGS. 1 and 2 disclose a connection arrangement for using a winch in different driving situations. For the sake of illustration, the channels along which pressure fluid flows or which have high pressure are shown in the figures drawn with a bolder line than the rest of the channels. The connection arrangement comprises a winch 1 which includes a wire drum 2 and a wire 3 that can be spooled onto the wire drum. The wire drum 2 is connected to a gearing 4 and via that to a pressure fluid motor 5, whereby the speed of rotation and the rotation moment of the pressure fluid motor and, respectively, the speed of rotation and the spool moment of the wire drum can be adjusted with respect to one another. A brake 6 is further arranged on the shaft of the pressure fluid motor 5, which brake when the equipment is pressureless is compressed by springback factor and prevents the pressure fluid motor and the winch from revolving and, correspondingly, when conducting pressure fluid into the pressure fluid motor, the brake is released because of the pressure of the pressure fluid. Pressure fluid channels 7 and 8 are connected to the pressure fluid motor 5 and a pressure relief valve 9 is arranged between them. The pressure fluid channels 7 and 8 are further connected to a control valve 10, whereby the channel 8 has a direct contact with the control valve 10 and a pressure relief valve 11 and a non-return valve 12 are arranged parallelly into the channel 7 and after them the channels are further connected to the valve 10. The pressure relief valve 9 is pressure-controllable in such a manner that its limit pressure can be adjusted by separate external pressure. For this purpose, the equipment comprises a separate control valve 13 with which a pressure channel 14 of the pressure relief valve 9 can be connected to be controlled in the desired manner. To the control valve 13 is further connected an adjusting device 16 with a channel 15, which device is an adjustable pressure relief valve, and also a pressure meter 17. Similarly, to the valve is connected a return channel 18 leading to the pressure fluid container and also, a pressure channel 19 to which a pressure-controlled volume flow pump is connected to supply pressure fluid. A control channel 21 needed for the adjustment of a pump 20 is on one hand connected to the control valve 13 and on the other hand to the channels 7 and 8 of the pressure fluid motors 5 via a shuttle valve 22. Furthermore, a brake channel 23 is connected to this shuttle valve 22 which brake channel will release the brake 6 because of the fluid pressure on it. A control channel 24 of the pressure fluid valve 11 is connected to the channel 8 of the pressure fluid motor 5.

When driving the drilling equipment forwards in the direction of arrow A shown in FIG. 1, the valve 13 has to be moved from the position shown in FIG. 1 to the right, whereby the pressure of the pressure fluid supplied by the pump 20 affects further the channel 7 via the channel 19 and therefrom the pressure fluid motor 5 through the non-return valve 12. This pressure further affects the brake 6 via the shuttle valve 22 and releases it and the control valve 13 through a throttle 25 which valve 13 can be moved from the position shown in the figure to the left. This way the pressure fluid can flow to the pressure fluid container via the channel 18. During driving the wire 3 spools off the wire drum 2 and rotates the pressure fluid motor 5 at the same time. When the pressure fluid motor rotates, it supplies pressure fluid in the direction of arrows B counter to the pressure of the pressure fluid supplied by the pump 20 and as a result of this, the pressure fluid flows from the pressure fluid motor 5 along the channel 7 and further through the pressure relief valve 9 to the channel 8 and therefrom back to the pressure fluid motor. Correspondingly, the control channel 21 of the pump 20 is connected after the throttle 25 to a pressureless channel on the way to the pressure fluid container, whereby the output of the pressure fluid in the pump 20 is essentially zero and thus the pump does not produce pressure fluid flow even though it maintains the pressure of the pressure fluid. By means of the pressure valve 9 the power keeping the wire 3 tight is adjusted with the adjusting device 16, whereby the pressure value effective over it, which value is visible in the meter 17, indicates the load force of the wire. This can be adjusted in the desired manner as required by the conditions.

Correspondingly, FIG. 2 shows what effect the pressures and the flows of the pressure have in the arrangement when the rock drilling equipment is driven in the opposite direction at the same time as the wire is spooled and kept tight. In this situation the control valve 13 is moved from the position shown in the figure to the right, whereby the adjusting device 16 is connected via the control valve 13 to the control channel 21 of the pump 20. This way by means of the adjusting device 16 the pressure of the pump 20 and also the flow of the pressure fluid produced by the pump 20 can be adjusted. When the pressure fluid flows from the pump 20, it flows through the valve 10 further through the non-return valve 12 past the pressure relief valve 9 along the channel 7 to the pressure fluid motor 5. Similarly, the other pressure channel 8 of the pressure fluid motor 5 is connected directly via the valve 10 to the pressure fluid container. In this situation the speed of rotation of the winch 1 is adjusted by means of the adjusting device 16 and the tightness of the wire depends on how fast the rock drilling equipment can be driven in this direction. The pressure fluid flows in this situation as shown by arrows D from the pump around the entire channel to the pressure fluid motor and further back to the pressure fluid container.

In situations in which the wire should be spooled off by means of the winch, the control valve 10 is connected to the opposite direction with regard to FIGS. 1 and 2. At the same time the control valve 13 is kept in amid-position, whereby the pressure fluid from the pump 20 flows to the opposite inlet of the pressure fluid motor 5 via the channel 8 and, correspondingly, the pressure fluid discharging from it flows to the channel 7 and further via it to the pressure relief valve 11 and through it to the pressure fluid discharge channel 18. The pressure relief valve 11 receives the control pressure through its control channel 24 from the channel 8, whereby the pressure prevailing over the pressure fluid motor 5 can be set by means of the pressure relief valve 11. Then the pressure from the channel 8 flows to the shuttle valve 22 and through it via the channel 23 to the brake 6 and further to the control channel 21 of the pressure fluid pump 20. When the wire is to be spooled onto the wire drum without driving the equipment, the control valve 10 is moved from the position shown in the figure to the right, whereby the pressure fluid flow through the non-return valve 12 along the channel 7 to the hydraulic motor 5 and further along the channel 8 through the valve 10 to the discharge channel 18 and hence to the pressure fluid container.

The invention is above in the specification and in the drawings shown only by way of example and it is in no way restricted to it. It is essential to the invention that a pressure-controlled volume flow pump is used as a pressure fluid pump of the pressure fluid circuit of the winch, whereby pressure can be maintained in the system without the output of the pump having to be supplied by force through the pressure relief valve which adjusts the tightness moment of the winch. It is further essential that the control of the winch and the pressure fluid circuit is independent of the pressure fluid circuit of the drive motors of the equipment in such a manner that it can be adjusted independently as well as possible as required by the conditions. It is also essential that the tightness of the wire when spooling the wire off can be adjusted in a desired manner and, correspondingly, the spooling of the winch can be adjusted as required by the conditions.

I claim:

1. An arrangement for controlling a winch cable connected to rock drilling equipment, the arrangement comprising the winch; a pressure fluid motor arranged to operate the winch; a pressure fluid pump for operating the pressure fluid motor; a pressure-controlled pressure relief valve installed between a pair of pressure fluid channels connected to the pressure fluid motor for setting a counterpressure of the pressure fluid motor when pulling the cable off a drum; and control means for controlling counterpressure of the pump;

wherein the pump is a pressure-controlled volume flow pump and the control means comprise an adjusting device with which a control pressure prevailing in a control channel of said pressure relief valve can be adjusted for setting a limit pressure of the pressure relief valve and thus the counterpressure of the pressure fluid motor.

2. An arrangement according to claim 1 including a control valve by which the adjusting device can be connected so as to affect said control channel of the pressure relief valve and at the same time, a control channel of the pressure fluid pump can be connected with a pressure fluid container, whereby the counterpressure of the pressure fluid motor can be adjusted with the adjusting device at the same time as the output of the pressure fluid pump is essentially zero.

3. An arrangement according to claim 2, wherein said adjustment device can be connected with the control valve so as to control said control channel of the pressure fluid pump for adjusting the output of said pressure fluid pump and thus the speed of rotation of the pressure fluid motor when spooling the cable onto the wire drum.

* * * * *

UNITED STATES PATENT AND TRADEMARK OFFICE

CERTIFICATE OF CORRECTION

PATENT NO. : 6,012,707

DATED : January 11, 2000

INVENTORS : Pentti Enlund

It is certified that error appears in the above-identified patent and that said Letters Patent is hereby corrected as shown below:

On the title page, item [56]:

Insert the following additional reference citation under U.S. PATENT DOCUMENTS on the first page:

--4,610,139 9/1986 Skelly.....60/327--

Delete claims 1-3 and replace them with the following claims:

--1. An arrangement for controlling a winch connected to rock drilling equipment, the arrangement comprising a winch having a drum and a cable adapted to be spooled onto and off the drum; a pressure fluid motor for operating the winch; a pressure fluid pump for supplying a pressure fluid to the pressure fluid motor; a pair of pressure fluid channels; a pressure-controlled pressure relief valve installed between the pair of pressure fluid channels and connected to the pressure fluid motor for setting a counterpressure of the pressure fluid motor when the cable is spooled off the drum; and control means for controlling counterpressure of the pump;

wherein the pump is a pressure-controlled volume flow pump and the control means comprise an adjusting device with which a control pressure prevailing in a control channel of said pressure relief valve can be adjusted for setting a limit pressure of the pressure relief valve and thus the counterpressure of the pressure fluid motor.

2. An arrangement according to claim 1 including a control valve which permits the adjusting device to be connected to said control channel of the pressure relief valve and at the same time a control channel of the pressure fluid pump can be connected with a pressure fluid

UNITED STATES PATENT AND TRADEMARK OFFICE

CERTIFICATE OF CORRECTION

PATENT NO. : 6,012,707

DATED : January 11, 2000

INVENTORS : Pentti Enlund

It is certified that error appears in the above-identified patent and that said letters Patent is hereby corrected as shown below:

container, whereby the counterpressure of the pressure fluid motor can be adjusted with the adjusting device at the same time as the output of the pressure fluid pump is essentially zero.

3. An arrangement according to claim 2, wherein said adjustment device can be connected via the control valve to said control channel of the pressure fluid pump for adjusting the output of said pressure fluid pump and thus the speed of rotation of the pressure fluid motor when spooling the cable onto the drum.--

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*